US005704282A

United States Patent [19]

Khalid

[11] Patent Number: 5,704,282

[45] Date of Patent: Jan. 6, 1998

[54] METHOD OF GENERATING PROOFS OF PRINT SIGNATURES

[75] Inventor: Najeeb Khalid, Westmount, Canada

[73] Assignee: Escher-Grad Technologies Inc., Lachine, Canada

[21] Appl. No.: 715,219

[22] Filed: Sep. 17, 1996

[51] Int. Cl.[6] ..... B41J 15/06; B41J 2/525

[52] U.S. Cl. ..... 101/93.01; 101/93.11

[58] Field of Search ..... 101/93.01, 93.11, 101/93.12, 179, 181, 484, 485, 486, 220, 221, 223; 347/4, 5, 172; 355/23, 24, 407, 408

[56] References Cited

U.S. PATENT DOCUMENTS

| | | | |
|---|---|---|---|
| 5,031,530 | 7/1991 | Burger | 101/180 X |
| 5,069,124 | 12/1991 | Schneider | 101/483 |

FOREIGN PATENT DOCUMENTS

| | | |
|---|---|---|
| 317762 | 5/1989 | European Pat. Off. . |
| 319223 | 10/1990 | European Pat. Off. . |
| 2605268 | 4/1988 | France . |

OTHER PUBLICATIONS

Esher–Grad Technologies Inc., Advertising Leaflet on "TrueProofer", May 1995.

*Primary Examiner*—J. Reed Fisher

*Attorney, Agent, or Firm*—Foley & Lardner

[57] ABSTRACT

The invention relates to a method of generating proofs of print signatures composed of first and second flats printed on opposite sides of a sheet. The method of the invention comprises the steps of (a) providing first and second digital printing units; (b) feeding a substrate having opposite sides to the first printing unit; (c) actuating the first printing unit while feeding thereto digital data representative of an image of the first flat so as to imprint one side of the substrate with the image of the first flat; (d) providing the substrate with a registration mark at a predetermined location on the substrate, before or during step (c); (e) conveying the imprinted substrate from the first printing unit to the second printing unit and feeding same thereto; (f) detecting the location of the registration mark on the substrate and actuating the second printing unit while feeding thereto digital data representative of an image of the second flat so as to imprint the other side of the substrate with the image of the second flat positioned with respect to the detected location of the registration mark such that the image of the second flat registers with the image of the first flat, thereby obtaining a proof of a print signature; and (g) discharging the proof of print signature from the second printing unit. Such a method enables one to avoid generating films from the digital data representative of both flats and preparing a proof from such films.

10 Claims, 1 Drawing Sheet

METHOD OF GENERATING PROOFS OF PRINT SIGNATURES

BACKGROUND OF THE INVENTION

The present invention pertains to improvements in the field of offset lithography. More particularly, the invention is concerned with an improved method of generating proofs of print signatures.

The process of offset printing from digitally generated information requires many steps that result in composite images and text on film. This film is used to make offset printing plates. The plates are then mounted on a printing press to produce multiple impressions on paper. Prior to committing the result of such a complex process to the press, that is to commence printing thousands of impressions, it is necessary to make one impression as a proof for obtaining approval of the customer prior to printing.

Printers print multiple page images on both sides of a large sheet of paper. Such a printed sheet is called a print signature. A single printed side, on the other hand, is called a flat. Thus, a print signature is composed of two flats printed on opposite sides of a sheet. The page images on each flat are positioned in a manner such that they are in the correct sequence after folding the print signature. The proof that a printer requires must have is the proof of the print signature.

Proofs of print signatures are prepared from the films, and if corrections have to be made, new films incorporating the necessary corrections have to be generated again. This results in extra manpower and cost of generating new films and new proofs for each and every iteration.

Technology has made it possible to generate offset printing plates directly without the intermediate steps of generating a film and then the plate from the film. This makes it impossible to generate proofs prior to printing. As most printers are unwilling to print without obtaining the approval of a proof by their customer, they are unable to use such a new technology.

SUMMARY OF THE INVENTION

It is therefore an object of the present invention to overcome the above drawbacks and to provide an improved method of generating proofs of print signatures.

In accordance with the invention, there is thus provided a method of generating proofs of print signatures composed of first and second flats printed on opposite sides of a sheet. The method of the invention comprises the steps of:

a) providing first and second digital printing units;

b) feeding a substrate having opposite sides to the first printing unit;

c) actuating the first printing unit while feeding thereto digital data representative of an image of the first flat so as to imprint one side of the substrate with the image of the first flat;

d) providing the substrate with a registration mark at a predetermined location on the substrate, before or during step (c);

e) conveying the imprinted substrate from the first printing unit to the second printing unit and feeding same thereto;

f) detecting the location of the registration mark on the substrate and actuating the second printing unit while feeding thereto digital data representative of an image of the second flat so as to imprint the other side of the substrate with the image of the second flat positioned with respect to the detected location of the registration mark such that the image of the second flat registers with the image of the first flat, thereby obtaining a proof of a print signature; and g) discharging the proof of print signature from the second printing unit.

According to a preferred embodiment, the imprinted substrate is provided with slack between the first and second printing units prior to being fed to the second printing unit. Such a slack prevents the imprinted substrate from undergoing tensioning between the first and second printing units and possible rupture.

According to another preferred embodiment, the first and second printing units are separate printing units each having an inlet for receiving the substrate and an outlet for discharging same, and they are coupled together by a bridge connecting the outlet of the first printing unit with the inlet of the second printing unit. The imprinted substrate is conveyed from the fist printing unit to the second printing unit by passing the imprinted substrate along such a bridge.

Preferably, each printing unit has a resolution ranging from about 300 to about 600 dots per inch, and the digital data is representative of the image of a flat at about 90,000 pixels per square inch.

The method of the invention enables one to avoid generating films from the digital data representative of both flats and preparing a proof from such films.

BRIEF DESCRIPTION OF THE DRAWINGS

Further features and advantages of the invention will become more readily apparent from the following description of a preferred embodiment as illustrated by way of example in the accompanying drawings, in which.

DESCRIPTION OF PREFERRED EMBODIMENTS

Figure 1:
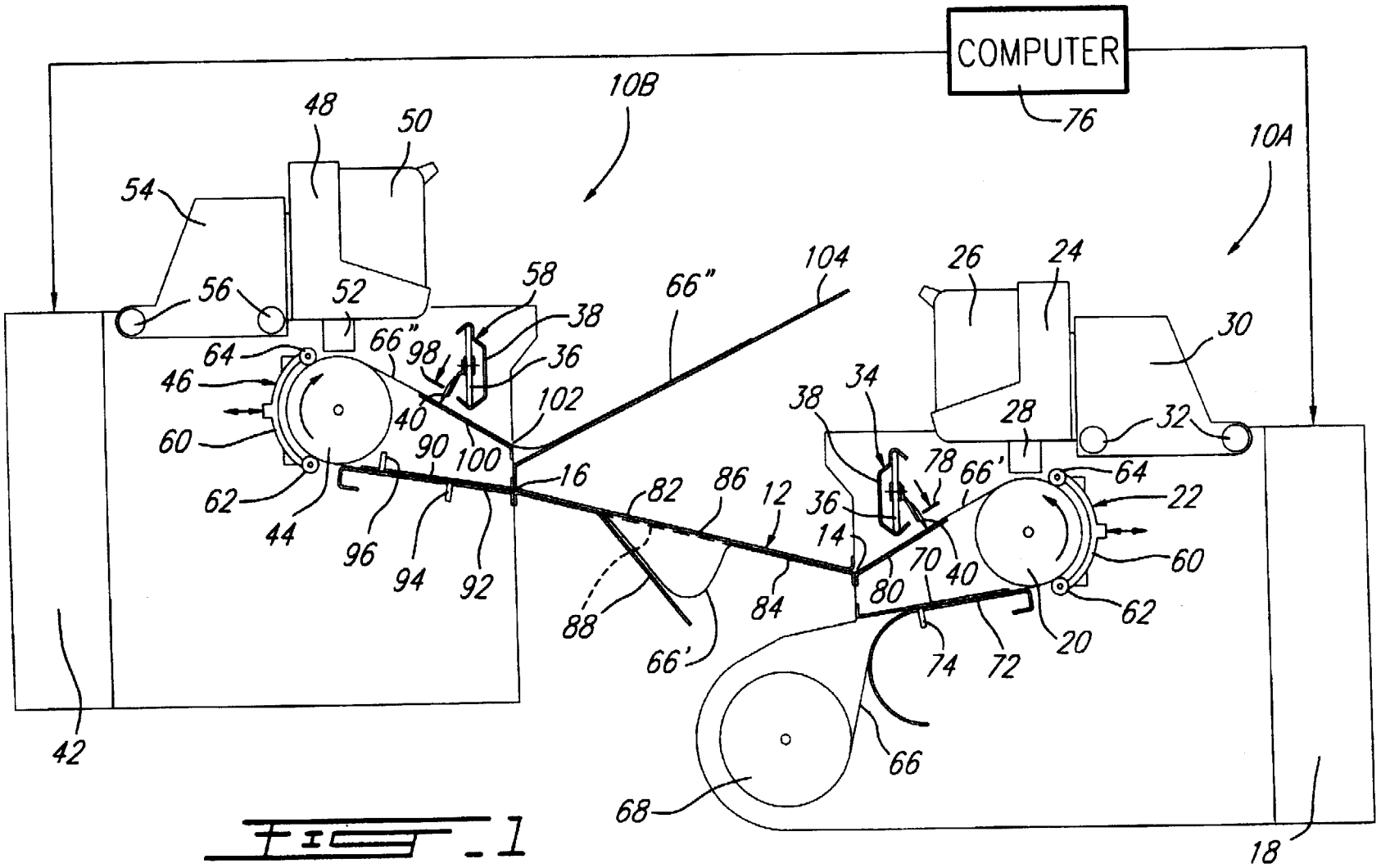
FIG. 1 schematically illustrates two digital printing units arranged to generate proofs of print signatures, in accordance with a preferred embodiment of the invention.

As shown in FIG. 1, two digital printing units 10A and 10B are coupled together by a bridge 12 which connects the outlet 14 of unit 10A with the inlet 16 of unit 10B. Printing unit 10A comprises a control system 18, an impression cylinder 20, a movable paper guiding device 22, a cartridge holder 24 for holding a plurality of ink cartridges 26 (only one shown) of different colors, and a printing head 28 integral with the holder 24. The cartridge holder 24 in turn is mounted to a carriage 30 which is movable along guide rods 32 so as to displace the printing head 28 in a direction parallel to the rotation axis of the impression cylinder 20. The printing unit 10A further includes a paper cutting device 34 comprising a wheel 36 which is movable along a guide rail 38 and carries a rotatable disk blade 40. Similarly, the printing unit 10B comprises a control system 42, an impression cylinder 44, a movable paper guiding device 46, a cartridge holder 48 for holding a plurality of ink cartridges 50 (only one shown) of different colors, and a printing head 52 integral with the holder 48. The cartridge holder 48 is mounted to a carriage 54 which is movable along guide rods 56 so as to displace the printing head 52 in a direction parallel to the rotation axis of the impression cylinder 44. The printing unit 10B further includes a paper cutting device 58 which is identical to the device 34. The paper guiding devices 22 and 46 are also identical to one another and each comprise an arcuate member 60 and two idler rollers 62,64 rotatably mounted at the extremities of the member 60.

A continuous web 66 of paper is fed from a paper roll 68 to the printing unit 10A, between upper and lower guide members 70,72. An optical detector 74 is provided for detecting the leading edge of the paper web 66 so as to trigger, via the control system 18, rotation of the impression cylinder 20 and movement of the paper guiding device 22 in a direction away from the cylinder 20. After the paper web 66 has passed beyond the idler roller 62, the device 22 is moved in a direction towards the cylinder 20 to guide the paper web 66 around the cylinder and through the gap defined between the printing head 28 and the cylinder 20. The printing head 28 prints a registration mark on one side of the paper web 66 at a predetermined location, for example, in a margin next to the first line of one of the two flats to be printed on opposite sides of the web. Digital data representative of an image of the first flat is fed from the computer 76 to the printing head 28 via the control system 18 for imprinting one side of the paper web 66 with the image of the first flat. The imprinted paper web 66' then passes between a movable pressure plate 78 and a support plate 80 and then on the latter, exits the printing unit 10A through the outlet 14 thereof, and passes through the bridge 12 comprising top and bottom walls 82,84. The bottom wall 84 of the bridge 12 is provided with an opening 86 which is initially closed by a door 88 hinged to the wall 84.

The imprinted paper web 66' enters the printing unit 10B through the inlet 16 thereof and passes between upper and lower guide members 90 and 94. An optical detector 94 is provided for detecting the leading edge of the imprinted paper web 66' so as to trigger, via the control system 42, rotation of the impression cylinder 44 and movement of the paper guiding device 46 in a direction away from the cylinder 44. After the imprinted paper web 66' has passed beyond the idler roller 62, the device 46 is moved in a direction towards the cylinder 44 so that the web 66' is engaged between the cylinder 44 and roller 62. The door 88 is opened and rotation of the impression cylinder 44 is stopped for a period of time sufficient to provide the imprinted paper web 66' with slack, the slacked web 66' hanging from the bridge 12 through the opening 86, as shown in FIG. 1. Rotation of the cylinder 44 is then resumed. The imprinted paper web 66' is guided by the device 46 around the cylinder 44 and through the gap defined between the printing head 52 and the cylinder 44. Another optical sensor 96 is provided for detecting the location of the registration mark printed on the web 66' by the printing head 28.

After a period of time determined by the control system 42 has elapsed following detection of the registration mark, digital data representative of an image of the second flat is fed to the printing head 52 via the control unit 42 so as to imprint the other side of the paper web with the image of the second flat positioned with respect to the detected location of the registration mark such that the image of the second flat registers with the image of the first flat, thereby obtaining a proof 66" of a print signature. The proof 66" of print signature passes between a movable pressure plate 98 and a support plate 100 and then on the latter, exits the printing unit 10A through the outlet 102 thereof, and is discharged onto an inclined tray 104.

When a single proof 66" of a print signature is required, the imprinted paper web 66' is cut with the paper cutting device 34 of printing unit 10A. To this end, rotation of the impression cylinder 20 is stopped after the complete image of the first flat has been printed on one side of the paper web 66, the pressure plate 78 is moved to press the paper web against the support plate 80 and the paper web is cut with the disk blade 40, the other side of the paper web being imprinted with the image of the second flat by the printing head 52 of unit 10B. On the other hand, when several proofs of print signatures are required, the paper cutting device 58 of the printing unit 10B is used. After the complete image of the second flat has been printed, rotation of the impression cylinder 44 is temporarily stopped, the pressure plate 98 is moved to press the paper web against the support plate 100 and the paper web is cut with the disk blade 40 of device 58. The pressure plate 98 is then moved back to its initial position and rotation of the cylinder 44 is resumed for generating another proof of print signature.

I claim:

1. A method of generating proofs of print signatures composed of first and second flats printed on opposite sides of a sheet, comprising the steps of:

a) providing first and second digital printing units;

b) feeding a substrate having opposite sides to said first printing unit;

c) actuating said first printing unit while feeding thereto digital data representative of an image of said first flat so as to imprint one side of said substrate with the image of said first flat;

d) providing said substrate with a registration mark at a predetermined location on said substrate, before or during step (c);

e) conveying the imprinted substrate from said first printing unit to said second printing unit and feeding same thereto;

f) detecting the location of said registration mark on said substrate and actuating said second printing unit while feeding thereto digital data representative of an image of said second flat so as to imprint the other side of said substrate with the image of said second flat positioned with respect to the detected location of said registration mark such that the image of said second flat registers with the image of said first flat, thereby obtaining a proof of a print signature; and g) discharging said proof of print signature from said second printing unit.

2. A method as claimed in claim 1, wherein said first and second printing units are separate printing units each having an inlet for receiving said substrate and an outlet for discharging same, said first and second printing units being coupled together by a bridge connecting the outlet of said first printing unit with the inlet of said second printing unit, and wherein the imprinted substrate is conveyed from said first printing unit to said second printing unit by passing said imprinted substrate along said bridge.

3. A method as claimed in claim 1, further including the step of providing the imprinted substrate with slack between said first and second printing units prior to feeding same to said second printing unit.

4. A method as claimed in claim 2, further including the step of providing the imprinted substrate with slack between said first and second printing units prior to feeding same to said second printing unit, the slacked substrate being allowed to hang from said bridge through an opening formed therein.

5. A method as claimed in claim 1, wherein step (d) is carried out by printing said registration mark on said one side of said substrate.

6. A method as claimed in claim 1 or 5, wherein said registration mark is detected by means of an optical detector.

7. A method as claimed in claim 1, wherein each said printing unit has a resolution ranging from about 300 to about 600 dots per inch.

8. A method as claimed in claim 1, wherein said digital data is representative of the image of a flat at about 90,000 pixels per square inch.

9. A method as claimed in claim 1, wherein said substrate is in the form of a continuous web and is cut prior to being fed to said second printing unit.

10. A method as claimed in claim 1, wherein said substrate is in the form of a continuous web and is cut after having been imprinted on both sides with said images, and prior to being discharged from said second printing unit.

* * * * *